US011577278B2

(12) United States Patent
Salminen

(10) Patent No.: US 11,577,278 B2
(45) Date of Patent: Feb. 14, 2023

(54) MOBILE MINERAL MATERIAL PROCESSING STATION

(71) Applicant: Metso Outotec Finland Oy, Tampere (FI)

(72) Inventor: Vesa-Matti Salminen, Tampere (FI)

(73) Assignee: Metso Outotec Finland Oy, Tampere (FI)

( * ) Notice: Subject to any disclaimer, the term of this patent is extended or adjusted under 35 U.S.C. 154(b) by 0 days.

(21) Appl. No.: 17/415,383

(22) PCT Filed: Dec. 19, 2019

(86) PCT No.: PCT/FI2019/050912
§ 371 (c)(1),
(2) Date: Jun. 17, 2021

(87) PCT Pub. No.: WO2020/128166
PCT Pub. Date: Jun. 25, 2020

(65) Prior Publication Data

US 2022/0062952 A1 Mar. 3, 2022

(30) Foreign Application Priority Data

Dec. 21, 2018 (FI) ..... 20186128

(51) Int. Cl.
*B07B 13/16* (2006.01)
*B07B 1/00* (2006.01)

(52) U.S. Cl.
CPC ..... *B07B 13/16* (2013.01); *B07B 1/005* (2013.01); *B07B 2201/04* (2013.01)

(58) Field of Classification Search
CPC ..... B07B 13/16; B07B 1/005; B07B 2201/04
(Continued)

(56) References Cited

U.S. PATENT DOCUMENTS 6,186,338 B1 2/2001 Douglas
2010/0135758 A1* 6/2010 Gallione ..... B65G 41/005 414/505

(Continued)

FOREIGN PATENT DOCUMENTS

CA 2903563 A1 * 9/2013 ..... B07B 1/005
CA 2957740 A1 8/2017

(Continued)

OTHER PUBLICATIONS

Search Report issued in the Finnish priority Application No. 20186128 dated Jul. 26, 2019.

(Continued)

*Primary Examiner* — Terrell H Matthews
(74) *Attorney, Agent, or Firm* — Andrus Intellectual Property Law, LLP

(57) ABSTRACT

A mobile mineral material processing station has a mobile platform having tracks or wheels or a skids for supporting or forming a body that supports in line, in a transport configuration: a feed conveyor; a screen frame and a multi-layer screen; first and second exit conveyors; and a third exit conveyor on top of the first and second exit conveyors. The first exit conveyor turns from a transport position, under the third exit conveyor, to a first operation direction, onto a first side of the station, for operating the station, and back. The second exit conveyor turns from a transport position, under the third exit conveyor, to a second operation direction onto a second side of the station, opposite to the first side, and back.

15 Claims, 2 Drawing Sheets

(58) Field of Classification Search
USPC ..... 209/421
See application file for complete search history.

(56) References Cited

U.S. PATENT DOCUMENTS

| | | | | |
|---|---|---|---|---|
| 2013/0037455 | A1* | 2/2013 | Irwin | B07B 1/286 209/257 |
| 2016/0279644 | A1* | 9/2016 | Stemper | B07B 1/005 |

FOREIGN PATENT DOCUMENTS

| | | | | | |
|---|---|---|---|---|---|
| CN | 104261085 | A | | 1/2015 | |
| CN | 204602610 | U | | 9/2015 | |
| CN | 105593145 | A | | 5/2016 | |
| CN | 106733620 | A | | 5/2017 | |
| CN | 107073476 | A | | 8/2017 | |
| CN | 107185818 | A | | 9/2017 | |
| CN | 107899942 | A | | 4/2018 | |
| GB | 1480688 | A | * | 7/1977 | B07B 1/005 |
| GB | 1480688 | A | | 7/1977 | |
| GB | 2427158 | B | | 10/2007 | |
| GB | 201405144 | | | 5/2014 | |
| GB | 2526769 | A | | 12/2015 | |
| GB | 2526769 | A | * | 12/2015 | B02C 21/02 |
| WO | 9741971 | A | | 11/1997 | |
| WO | WO-9741971 | A1 | * | 11/1997 | B02C 21/02 |
| WO | 2005024141 | A2 | | 3/2005 | |
| WO | 2013102699 | A1 | | 7/2013 | |
| WO | WO-2013102699 | A1 | * | 7/2013 | B02C 21/02 |
| WO | 2013131145 | A1 | | 9/2013 | |
| WO | WO-2013131145 | A1 | * | 9/2013 | B07B 1/005 |
| WO | 2016050326 | A1 | | 4/2016 | |
| WO | WO-2021123502 | A1 | * | 6/2021 | B07B 1/005 |

OTHER PUBLICATIONS

International Search Report and Written Opinion for International Application No. PCT/FI2019/050912 dated Mar. 17, 2020.
Office Action and Search Report for corresponding Chinese Patent Application No. 201980083193.2 dated Jul. 1, 2022.

* cited by examiner

MOBILE MINERAL MATERIAL PROCESSING STATION

CROSS-REFERENCE TO RELATED APPLICATIONS

This application is the U.S. national stage application of International Application PCT/FI2019/050912, filed Dec. 19, 2019, which international application was published on Jun. 25, 2020, as International Publication WO 2020/128166 A1 in the English language. The International Application claims priority of Finnish Patent Application No. 20186128 filed Dec. 21, 2018.

TECHNICAL FIELD

The present invention generally relates to a mobile mineral material processing station.

BACKGROUND ART

This section illustrates useful background information without admission of any technique described herein representative of the state of the art.

Mineral material is processed by screening or crushing with mobile stations that are self-propelled or towable. Mobility of such stations is improved by compacting to a transport configuration. GB 2526769 A presents an example of a mobile screening apparatus for handling bulk material and especially in a portable or mobile format. The apparatus of GB 2526769 A has a feed conveyor and screen that can be brought to overlap and tilt upwards by their adjacent ends and also three exit conveyors, two of which can be folded onto the screen so that the entire apparatus is largely compacted for ease of transportation. The foldable side conveyors appear to be manually foldable and there are rectangular profiled telescopic supports for holding the foldable side conveyors in an extended configuration. A central exit conveyor is fixedly mounted.

It is an object of the invention to enhance portability of a mobile mineral material processing station or to improve an operating configuration of the mobile mineral material processing station or to at least provide a new technical alternative.

SUMMARY

According to a first example aspect of the invention there is provided a mobile mineral material processing station comprising a mobile platform comprising tracks or wheels or a skids. The apparatus is characterized in that the apparatus further comprises:

a body supported by or formed by the mobile platform;

supported by the body in line, when the station is in a transport configuration: a feed conveyor; a screen with multiple layers for separating three or more different fractions of mineral material; a first exit conveyor; a second exit conveyor; and a third exit conveyor on top of the first and second exit conveyors;

a first turning mechanism configured to enable turning the first exit conveyor from a transport position that is under the third exit conveyor to a first operation direction onto a first side of the mobile mineral material processing station for operating the mineral material processing station and back to the transport position for transporting the mineral material processing station; and a second turning mechanism configured to enable turning the second exit conveyor from a transport position under the third exit conveyor to a second operation direction onto a second side of the mobile mineral material processing station, opposite to the first side, and back to the transport position for transporting the mineral material processing station.

Advantageously, the feed conveyor and the first, second and third exit conveyors can be pivoted inline to a compact transport arrangement. Reducing the machine width in transport while having as wide screen as possible may be necessary or may help to fit the mobile mineral material processing station into a container, such as an ISO standard container.

The first exit conveyor may be internally pivotable. The first exit conveyor may be internally pivotable such that a first base portion of the first exit conveyor is fixedly mounted and remainder of the first exit conveyor is pivotable relative to the first base portion. The first base portion may comprise less than 20% of the length of the first exit conveyor. The first base portion may comprise less than 10% of the length of the first exit conveyor. The first base portion may comprise less than 5% of the length of the first exit conveyor.

The base portion of the first exit conveyor may be located under a discharge end of the screen.

The second exit conveyor may be internally pivotable. The second exit conveyor may be internally pivotable such that a second base portion of the second exit conveyor is fixedly mounted and remainder of the second exit conveyor is pivotable relative to the second base portion. The second base portion may comprise less than 20% of the length of the second exit conveyor. The second base portion may comprise less than 10% of the length of the second exit conveyor. The second base portion may comprise less than 5% of the length of the second exit conveyor.

The base portion of the second exit conveyor may be located under a discharge end of the screen.

The first and second exit conveyors may extend in the compact position to a longitudinal horizontal distance from the mobile platform that differs less than N per cent. N may be selected from a group consisting of: 0.1; 1; 2; 5; 10; and 20. Said horizontal distance of the first exit conveyor may be greater than that of the third exit conveyor by less than M per cent. M may be 50, 25, 10, 5 or 1.

The mobile mineral material processing station may further comprise a tilting mechanism configured to tilt the feed conveyor, the screen and the third exit conveyor from a compacted configuration to an extended operating configuration in which the feed conveyor slopes upwards, the screen slopes downwards and the third exit conveyor slopes upwards. In the compacted configuration, the feed conveyor, the screen and the third exit conveyor may be in their respective transport orientations.

The tilting mechanism may be configured to lift a screen-side end of the third exit conveyor on moving the third exit conveyor to the compacted configuration so that sufficient space is formed under the third exit conveyor for turning the first exit conveyor and the second exit conveyor to the transport position.

The transport orientation of the feed conveyor may be parallel with or at most 5, 10 or 15 degrees off a ground line of the mobile platform. The transport orientation of the screen may be parallel with or at most 5 degrees off a ground line of the mobile platform. The transport orientation of the third exit conveyor may be parallel with or at most 5, 10 or 15 degrees off a ground line of the mobile platform. The ground line may be defined by ground-facing parts of the mobile platform when seen from a side perpendicularly to longitudinal direction of the mobile mineral material processing station.

The tilting mechanism may be further configured maintain the third exit conveyor at a distance from the screen that remains constant during the tilting of the third exit conveyor.

The mobile platform may comprise tracks. The mobile platform may comprise wheels. The mobile platform may comprise skids.

The first actuator may be a linear actuator. The first actuator may be a hydraulic actuator. The first actuator may be a pneumatic actuator. The first actuator may be an electric actuator.

The tilting mechanism may comprise feed conveyor tilting arms. The tilting mechanism may comprise exit conveyor tilting arms. The feed conveyor tilting arms may comprise a first sub-arm and a second sub-arm that are pivotably connected to each other. The first sub-arm may be functionally connected to the screen to move with the screen. The second sub-arm may be functionally connected to the feed conveyor to move with feed conveyor. The mobile mineral material processing station may comprise a third actuator for tilting the screen. The third actuator may be connected to the first sub-arm.

The tilting mechanism may be configured to tilt the feed conveyor and the exit conveyor by angles deviating at most 5%. The tilting mechanism may be configured to tilt the feed conveyor and the exit conveyor by angles deviating at most 1%.

The tilting of the screen in the first rotational direction may increase sloping down of the screen away from the feed conveyor.

The screen may be rotated from a compacted orientation to an operating orientation by the tilting in the first rotational direction. The compacted orientation may be parallel with the ground line of the mobile platform.

The feed conveyor may be rotated from a compacted orientation to an operating orientation by the tilting in the second rotational direction. The compacted orientation may be parallel with the ground line of the mobile platform.

The exit conveyor may be rotated from a compacted orientation to an operating orientation by the tilting in the second rotational direction. The compacted orientation may be parallel with the ground line of the mobile platform.

The first operation direction may be freely adjustable in a first adjustment sector.

The second operation direction may be freely adjustable in a second adjustment sector.

Advantageously, the first and second exit conveyors can be pivoted by the first and second actuators, respectively, so that forming of heaps can be flexibly controlled. The first operation direction may be adjustable during operating the mobile mineral material processing station. The second operation direction may be adjustable during operating the mobile mineral material processing station. Advantageously, the forming of heaps can be dynamically controlled during operating of the mobile mineral material processing station. Further advantageously, the first or second side conveyor can be directed to discharge screened mineral material onto a conveyor or feed hopper of another mineral material processing station for quick and flexible field processing with a plurality of mineral material processing stations.

The first adjustment sector may be broader than 30 degrees. The first adjustment sector may be broader than 45 degrees. The first adjustment sector may be broader than 60 degrees. The first adjustment sector may be broader than 75 degrees. The first adjustment sector may be broader than 90 degrees. The first adjustment sector may be broader than 105 degrees. The first adjustment sector may be broader than 120 degrees. The first adjustment sector may be broader than 135 degrees. The first adjustment sector may be broader than 150 degrees. The first adjustment sector may be broader than 165 degrees.

The second adjustment sector may be broader than 30 degrees. The second adjustment sector may be broader than 45 degrees. The second adjustment sector may be broader than 60 degrees. The second adjustment sector may be broader than 75 degrees. The second adjustment sector may be broader than 90 degrees. The second adjustment sector may be broader than 105 degrees. The second adjustment sector may be broader than 120 degrees. The second adjustment sector may be broader than 135 degrees. The second adjustment sector may be broader than 150 degrees. The second adjustment sector may be broader than 165 degrees.

According to a second example aspect of the present invention, there is provided a mobile mineral material processing station that has a mobile platform that supports or forms a body. The body supports in line, in a transport configuration: a feed conveyor; a screen frame and a multi-layer screen; a first exit conveyor; a second exit conveyor; and a third exit conveyor on top of the first exit conveyor and the second exit conveyor. A first exit conveyor turns from a transport position that is under the third exit conveyor to a first operation direction onto a first side of the station for operating the station and back to the transport position. A second exit conveyor turns from a transport position under the third exit conveyor to a second operation direction onto a second side of the station, opposite to the first side, and back to the transport position.

According to a third example aspect of the invention there is provided a method in a mobile mineral material processing station comprising a mobile platform comprising tracks or wheels or a skids. The method is characterized in:

supporting or forming a body by the mobile platform;

supporting by the body in line, when the station is in a transport configuration: a feed conveyor; a screen with multiple layers for separating three or more different fractions of mineral material; a first exit conveyor; a second exit conveyor; and a third exit conveyor on top of the first and second exit conveyors;

turning the first exit conveyor from a transport position that is under the third exit conveyor to a first operation direction onto a first side of the mobile mineral material processing station for operating the mineral material processing station and back to the transport position for transporting the mineral material processing station; and turning the second exit conveyor from a transport position under the third exit conveyor to a second operation direction onto a second side of the mobile mineral material processing station, opposite to the first side, and back to the transport position for transporting the mineral material processing station.

Different non-binding example aspects and embodiments of the present invention have been illustrated in the foregoing. The embodiments in the foregoing are used merely to explain selected aspects or steps that may be utilized in implementations of the present invention. Some embodiments may be presented only with reference to certain example aspects of the invention. It should be appreciated that corresponding embodiments may apply to other example aspects as well.

BRIEF DESCRIPTION OF THE DRAWINGS

Some example embodiments of the invention will be described with reference to the accompanying drawings, in which.

DETAILED DESCRIPTION

In the following description, like reference signs denote like elements or steps.

Figure 1:
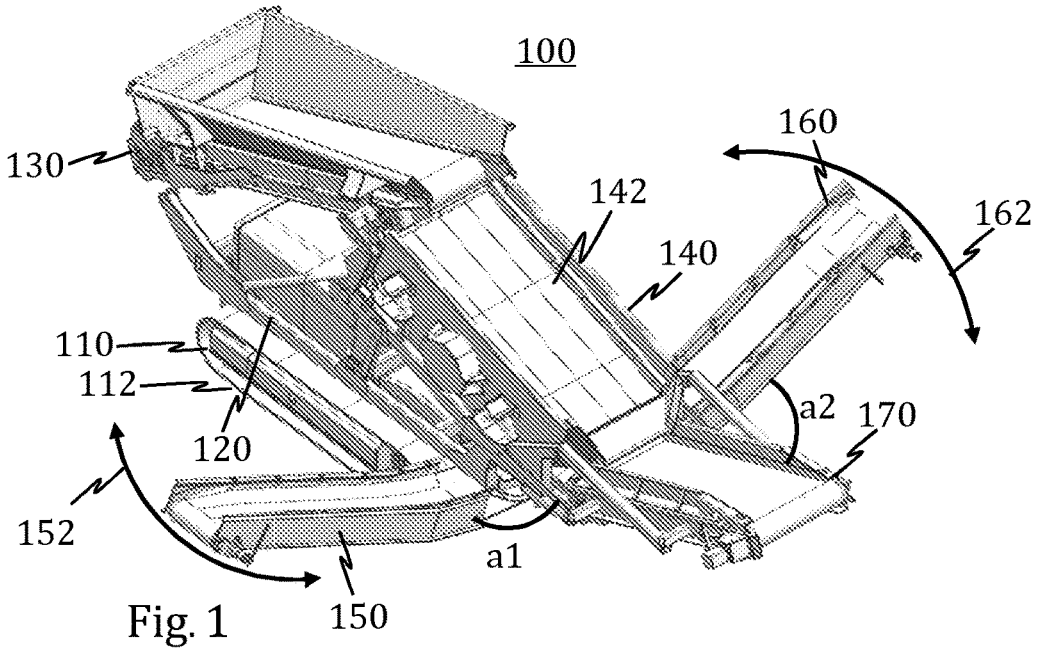
FIG. 1 shows in an operating configuration a mobile mineral material processing station.

FIG. 1 shows in an operating configuration a mobile mineral material processing station 100. The mobile mineral material processing station 100 comprises:

- a mobile platform 110 (510 in FIG. 5) comprising tracks 112 or wheels 520 (FIG. 5) or a skids (530);
- a body 120 supported by or formed by the mobile platform 110;
- supported by the body 120 in line, when in transport configuration: a feed conveyor 130; a screen frame 140 for a screen 142 with multiple layers 410, 420, 430 (FIG. 4) for separating three or more different fractions of mineral material; a first exit conveyor 150; a second exit conveyor 160; and a third exit conveyor 170 on top of the first and second exit conveyors 150, 160;
- a first turning mechanism 315 (FIG. 3), such as a first pivot with or without an optional actuator 610 (FIG. 6), configured to enable rotating the first exit conveyor 150 from a transport position that is under the third exit conveyor 170 to a first operation direction a1 onto a first side of the mobile mineral material processing station 100 for operating the mineral material processing station 100 and back to the transport position for transporting the mineral material processing station 100; and
- a second turning mechanism 325 (FIG. 3), such as a second pivot with or without an optional actuator 610 (FIG. 6), configured to enable rotating the second exit conveyor 160 from a transport position under the third exit conveyor 170 to a second operation direction a2 onto a second side of the mobile mineral material processing station 100, opposite to the first side, and back to the transport position for transporting the mineral material processing station 100.

The actuator can be a linear actuator. The actuator can be a hydraulic, pneumatic or electric actuator.

Advantageously, the feed conveyor 130 and the first, second and third exit conveyors 150, 160, 170 can be pivoted inline to a compact transport arrangement.

The first exit conveyor 150 of FIG. 1 is internally pivotable such that a first base portion 310 (FIG. 3) of the first exit conveyor 150 is fixedly mounted and a remainder of the first exit conveyor 150 is pivotable relative to the first base portion 310 with the first turning mechanism 315. In some embodiments, the first base portion 310 comprises less than 20, 10, or 5% of the length of the first exit conveyor 150.

The second exit conveyor 160 of FIG. 1 is internally pivotable such that a base portion 320 (FIG. 3) of the second exit conveyor 160 is fixedly mounted and remainder of the second exit conveyor 160 is pivotable relative to the base portion 320 of the second exit conveyor 160 with the second turning mechanism 325. In some embodiments, the second base portion 320 comprises less than 20, 10 or 5% of the length of the second exit conveyor 160.

The base portion of either or both first and second exit conveyors (150, 160) of FIG. 1 are located under a discharge end of the screen 142.

The first and second exit conveyors 150, 160 of some embodiments extend in the compact position to an overhang relative to the mobile platform that differs less than N per cent, wherein N is selected from a group consisting of: 0.1; 1; 2; 5; 10; and 20.

The mobile mineral material processing station 100 of FIG. 1 further comprises a tilting mechanism 220, 230 configured to tilt the feed conveyor 130, the screen 142 when mounted to the screen frame 140 and the third exit conveyor 170 from a compacted configuration to an extended operating configuration in which the feed conveyor 130 slopes upwards, the screen 142 when mounted to the screen frame 140 slopes downwards and the third exit conveyor 170 slopes upwards. In the compacted configuration, the feed conveyor 130, the screen 142 when mounted to the screen frame 140 and the third exit conveyor 170 are in their respective transport orientations.

Figure 2:
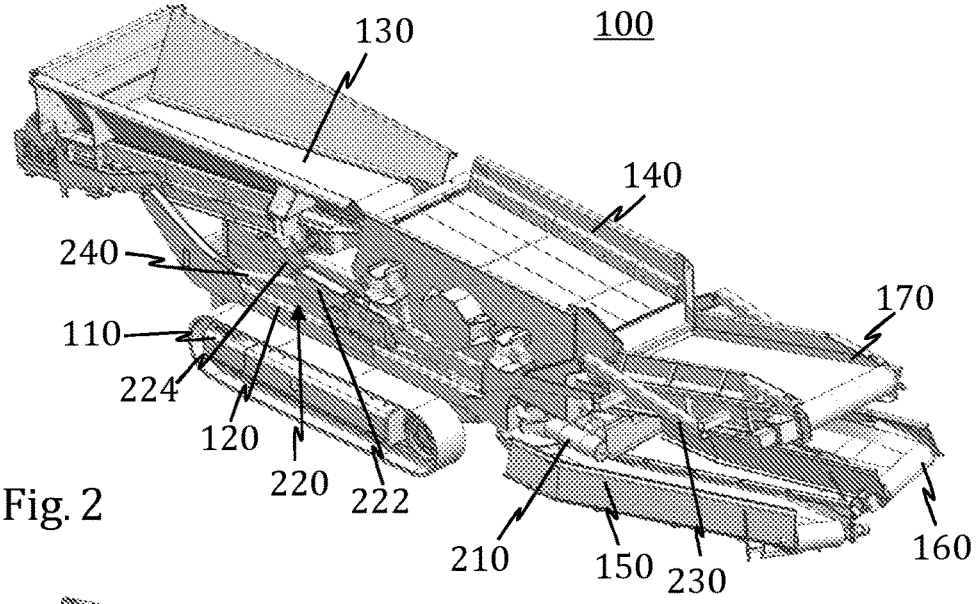
FIG. 2 shows the mobile mineral material processing station in a compacted or transport configuration.

FIG. 2 shows the mobile mineral material processing station 100 of FIG. 1 in the transport configuration. A conveyor belt is only partially drawn for the second exit conveyor 160 such that a conveyor roller 210 of the second exit conveyor 160 can be seen.

Figure 3:
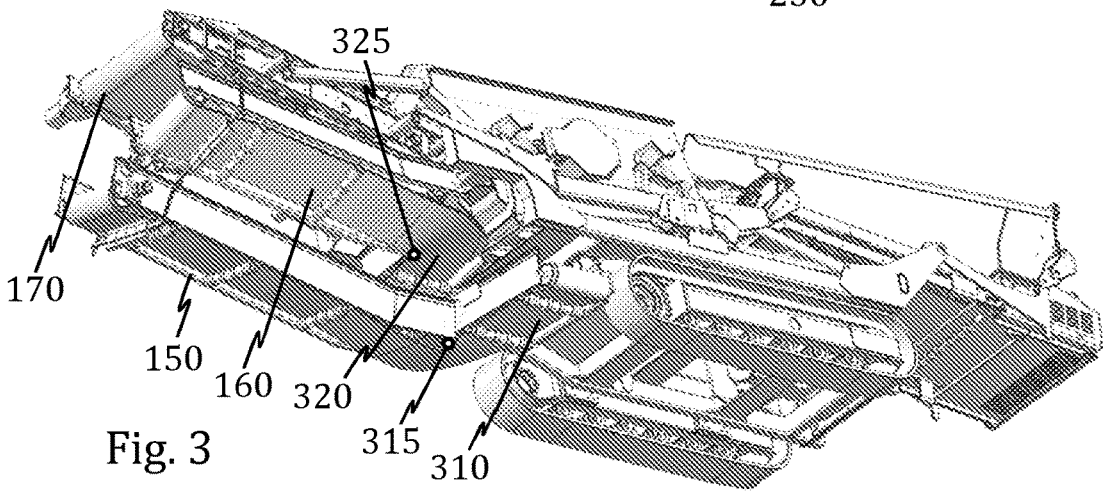
FIG. 3 shows the mobile mineral material processing station in a compacted or transport configuration from below.

In FIGS. 2 and 3, the transport orientation of the feed conveyor 130 is parallel with or at most 5 degrees off a ground line of the mobile platform 110. The transport orientation of the screen 142 when mounted to the screen frame 140 is in FIGS. 2 and 3 parallel with or at most 5 degrees off a ground line of the mobile platform 110. The transport orientation of the third exit conveyor 170 is in FIGS. 2 and 3 parallel with or at most 5 degrees off a ground line of the mobile platform 110.

The tilting mechanism 220, 230 of FIGS. 1 to 3 is further configured maintain the third exit conveyor 170 at a distance from the screen that remains constant during the tilting of the third exit conveyor 170.

The mobile platform of FIG. 1 comprises tracks 112.

FIGS. 1 to 3 are next described with further detail. The tilting mechanism comprises feed conveyor tilting arms 220 and exit conveyor tilting arms 230. The feed conveyor tilting arms 220 comprise a first sub-arm 222 and a second sub-arm 224 that are pivotably connected to each other. The first sub-arm is functionally connected to the screen frame 140 to move with the screen frame 140. The second sub-arm 224 is functionally connected to the feed conveyor to move with feed conveyor. The mobile mineral material processing station 100 further comprises a third actuator 240 for tilting the screen frame 140. The third actuator 240 is here connected to the first sub-arm 222.

The tilting mechanism 220, 230 is configured to tilt the feed conveyor 130 and the exit conveyor 170 by angles deviating at most 10% or 5% or 1%, for example.

The tilting of the screen 142 in the first rotational direction may increase sloping down of the screen 142 away from the feed conveyor 130.

The screen 142 can be rotated from a compacted orientation to an operating orientation by the tilting in the first rotational direction.

The feed conveyor 130 can be rotated from a compacted orientation to an operating orientation by the tilting in the second rotational direction.

The third exit conveyor 170 can be rotated from a compacted orientation to an operating orientation by the tilting in the second rotational direction.

The compacted orientation is preferably within 15, 10, 5 or 1 degrees from parallel with the ground line of the mobile platform.

In an embodiment, either one or both of the first and second operation directions a1, a2 are freely adjustable in respective first and second adjustment sectors 152, 162.

Figure 4:
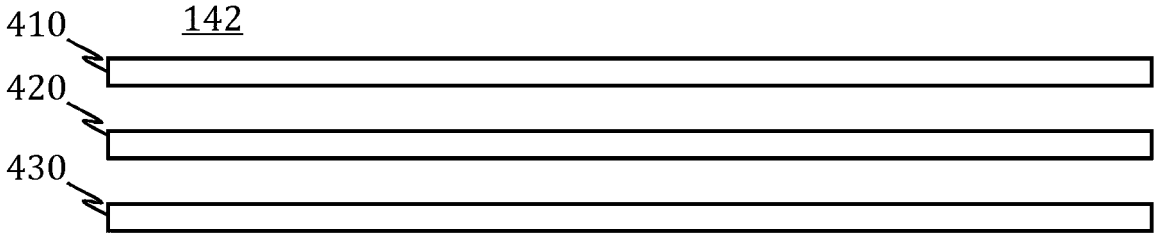
FIG. 4 shows a simplified cross-section of the screen of FIGS. 1 to 3.

FIG. 4 shows a simplified cross-section of the screen 142. The screen 142 comprises a first layer 410, a second layer 420 and a third layer 430 for screening different fractions of mineral material.

Figure 5:
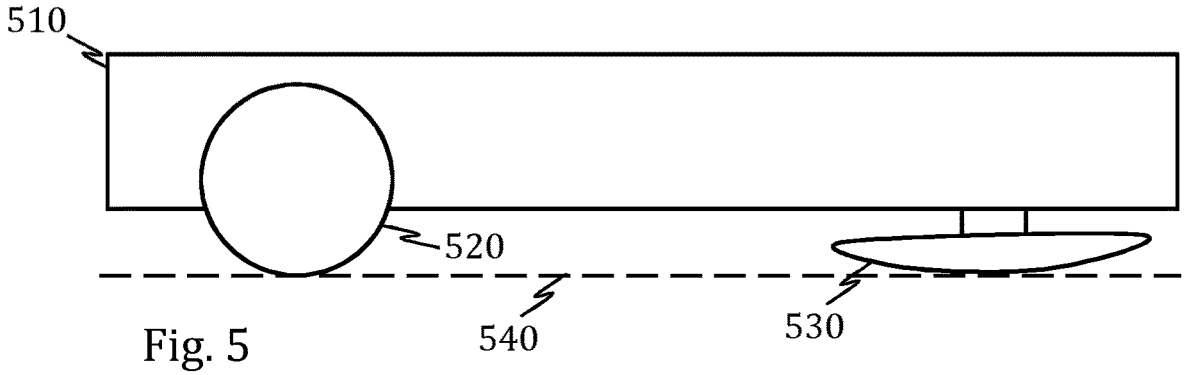
FIG. 5 shows a simplified side view of a mobile platform of an embodiment.

FIG. 5 shows a simplified side view of a mobile platform 510 of an embodiment. The mobile platform 510 comprises wheels 520 and skids 530 for both sides of the station 100. In other embodiments, there only wheels 510 or only skids 520. It is also possible to equip the mobile platform with only one broad and long skid that may optionally also form a portion of the mobile platform 510. FIG. 5 further shows a ground line shown by a dashed line that is the line defined by a ground contacting surface of the mobile platform 510 when at rest against the ground.

Figure 6:
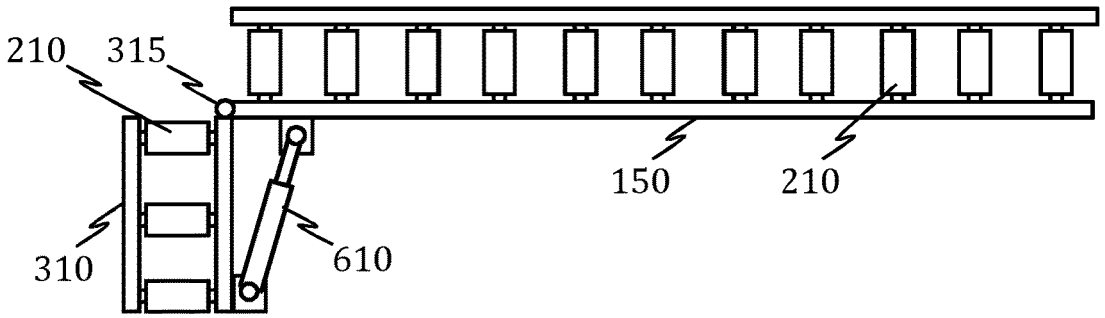
FIG. 6 shows a simplified drawing of turning mechanism of an embodiment.

FIG. 6 shows a simplified drawing of turning mechanism of an embodiment illustrating the internal pivot 315 of the first exit conveyor 150. FIG. 6 further shows an actuator that is here a linear actuator 610 for machine operated turning, which actuator may also be automatically operated or omitted for manual operation.

Figure 7:
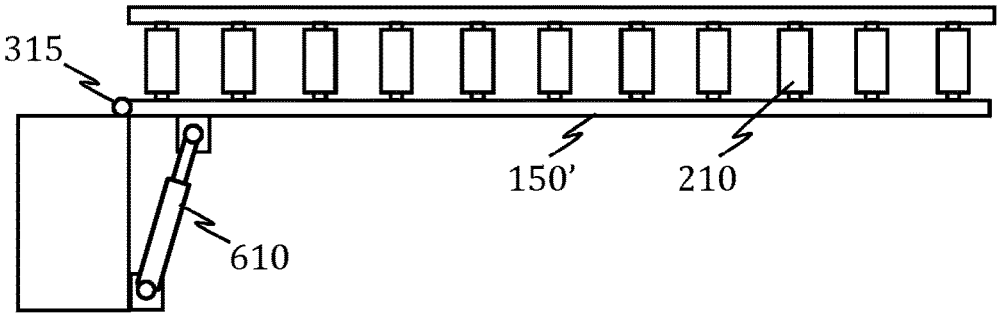
FIG. 7 shows a simplified drawing of turning mechanism of another embodiment.

FIG. 7 shows a simplified drawing of turning mechanism of another embodiment in which there is no internal pivoting but an entire exit conveyor 150' is turned about the pivot 315, optionally using the actuator 610.

Various embodiments have been presented. It should be appreciated that in this document, words comprise, include and contain are each used as open-ended expressions with no intended exclusivity.

The foregoing description has provided by way of non-limiting examples of particular implementations and embodiments of the invention a full and informative description of the best mode presently contemplated by the inventors for carrying out the invention. It is however clear to a person skilled in the art that the invention is not restricted to details of the embodiments presented in the foregoing, but that it can be implemented in other embodiments using equivalent means or in different combinations of embodiments without deviating from the characteristics of the invention. For example, the turning of the exit conveyors may be implemented using an arcuate sliding mechanism that allows the side conveyor turn over a varying pivot point.

Furthermore, some of the features of the afore-disclosed embodiments of this invention may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. A mobile mineral material processing station comprising:

a mobile platform comprising tracks or wheels or a skids;

a body supported by or formed by the mobile platform;

a feed conveyor;

a screen with multiple layers for separating three or more different fractions of mineral material;

a first exit conveyor;

a second exit conveyor;

a third exit conveyor, wherein the feed conveyor, the screen, the first exit conveyor, the second exit conveyor and the third exit conveyor are supported by the body in line with each other and the third exit conveyor is on top of the first exit conveyor and the second exit conveyor when the station is in a transport configuration;

a first turning mechanism configured to enable turning the first exit conveyor from a transport position that is in line with and under the third exit conveyor to a first operation direction onto a first side of the mobile mineral material processing station for operating the mineral material processing station and back to the transport position for transporting the mineral material processing station; and a second turning mechanism configured to enable turning the second exit conveyor from a transport position that is in line with and under the third exit conveyor to a second operation direction onto a second side of the mobile mineral material processing station, opposite to the first side, and back to the transport position for transporting the mineral material processing station.

2. The mobile mineral material processing station of claim 1, wherein the first exit conveyor includes a first base portion and a first discharge end, wherein the first base portion is fixedly mounted to the mobile platform and the first discharge end is pivotable relative to the first base portion.

3. The mobile mineral material processing station of claim 1, wherein the second exit conveyor includes a second base portion and a second discharge end, wherein the second base portion is fixedly mounted to the mobile platform and the second discharge end is pivotable relative to the second base portion.

4. The mobile mineral material processing station of claim 1, wherein a base portion of the first exit conveyor and a base portion of the second exit conveyor are located under a discharge end of the screen.

5. The mobile mineral material processing station of claim 1, wherein the transport orientation of the feed conveyor is parallel with or at most 15 degrees off a ground line of the mobile platform.

6. The mobile mineral material processing station of claim 1, further comprising a tilting mechanism configured to tilt the feed conveyor, the screen when mounted to the screen frame and the third exit conveyor from a compacted configuration to an extended operating configuration in which the feed conveyor slopes upwards, the screen when mounted to the screen frame slopes downwards and the third exit conveyor slopes upwards.

7. The mobile mineral material processing station of claim 6, wherein the tilting mechanism is further configured to maintain the third exit conveyor at a distance from the screen that remains constant during the tilting of the third exit conveyor.

8. The mobile mineral material processing station of claim 6, wherein the tilting mechanism is further configured to lift a screen-side end of the third exit conveyor on moving the third exit conveyor to the compacted configuration so that sufficient space is formed under the third exit conveyor for turning the first exit conveyor and the second exit conveyor to the transport position.

9. The mobile mineral material processing station of claim 6, wherein the tilting mechanism comprises feed conveyor tilting arms.

10. The mobile mineral material processing station of claim 6, wherein the tilting mechanism comprises third exit conveyor tilting arms.

11. The mobile mineral material processing station of claim 6, wherein the tilting mechanism is configured to tilt the feed conveyor and the third exit conveyor by angles deviating at most 15 degrees.

12. The mobile mineral material processing station of claim 6, wherein the feed conveyor tilting arms comprises a first sub-arm and a second sub-arm that are pivotably connected to each other.

13. The mobile mineral material processing station of claim 12, wherein the first sub-arm is functionally connected to the screen frame to move with the screen frame.

14. The mobile mineral material processing station of claim 6, wherein in the compacted configuration, feed conveyor, the screen when mounted to the screen frame and the third exit conveyor are in their respective transport orientations.

15. The mobile mineral material processing station of claim 6, wherein the first operation direction is freely adjustable in a first adjustment sector.

* * * * *